US008611788B2

(12) United States Patent
Yamamoto

(10) Patent No.: US 8,611,788 B2
(45) Date of Patent: Dec. 17, 2013

(54) IMAGE FORMING APPARATUS

(75) Inventor: Tatsuyuki Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 13/031,887

(22) Filed: Feb. 22, 2011

(65) Prior Publication Data

US 2011/0211868 A1 Sep. 1, 2011

(30) Foreign Application Priority Data

Mar. 1, 2010 (JP) ..... 2010-044328

(51) Int. Cl.
*G03G 15/08* (2006.01)
*G03G 21/18* (2006.01)

(52) U.S. Cl.
USPC ..... 399/119; 399/262

(58) Field of Classification Search
USPC ..... 399/119, 120
See application file for complete search history.

(56) References Cited

U.S. PATENT DOCUMENTS

| | | | | |
|---|---|---|---|---|
| 5,587,777 | A * | 12/1996 | Miyaji et al. | 399/120 |
| 5,614,996 | A * | 3/1997 | Tanda | 399/120 |
| 6,041,212 | A * | 3/2000 | Okada | 399/359 |
| 6,564,029 | B2 * | 5/2003 | Kojima et al. | 399/258 |
| 8,335,455 | B2 * | 12/2012 | Maeshima | 399/120 |
| 2002/0085857 | A1 * | 7/2002 | Kim et al. | 399/119 |
| 2005/0281590 | A1 * | 12/2005 | Tsuda et al. | 399/258 |
| 2006/0228134 | A1 * | 10/2006 | Ishiguro et al. | 399/258 |
| 2007/0071472 | A1 | 3/2007 | Kubo et al. | |
| 2007/0237551 | A1 * | 10/2007 | Kawai | 399/258 |
| 2008/0181673 | A1 * | 7/2008 | Kim et al. | 399/258 |
| 2010/0209147 | A1 | 8/2010 | Kubo et al. | |
| 2011/0170907 | A1 | 7/2011 | Yamamoto | |
| 2011/0206419 | A1 | 8/2011 | Yamamoto | |

FOREIGN PATENT DOCUMENTS

| | | | |
|---|---|---|---|
| JP | 4-333077 | A | 11/1992 |
| JP | 11-174843 | A | 7/1999 |

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

An image forming apparatus includes an image bearing member; a developing device provided movably in a direction in which the developing device is to be moved away from the image bearing member; a supplying device, provided with a supply port through which a developer is to be supplied, for supplying the developer; a shutter member provided so that the supply port can be covered and uncovered; a first interrelating mechanism for moving the shutter member from an opposing position in which the shutter member opposes the supply port to a retracted position in interrelation with a mounting operation of the developing device; and a second interrelating mechanism for moving the shutter member from the retracted position to the opposing position in interrelation with a demounting operation of the developing device. The second interrelating mechanism includes an engaging portion for engaging the shutter member with the developing device by moving the shutter member to the retracted position and includes a releasing portion for releasing engagement between the shutter member and the developing device by moving the shutter member to the opposing position.

2 Claims, 5 Drawing Sheets

(a) MOUNTED STATE (b) PULLED OUT STATE

IMAGE FORMING APPARATUS

FIELD OF THE INVENTION AND RELATED ART

The present invention relates to an image forming apparatus including a supplying device provided with a supply port through which a developer is to be supplied to a developing device detachably mountable to a main assembly thereof. Specifically, the present invention relates to a driving mechanism for a shutter member for covering and uncovering the supply port in interrelation with a mounting and demounting operation of the developing device.

The image forming apparatus including the developing device for developing an electrostatic image formed on an image bearing member with the developer carried on a developer carrying member has been widely used. The developing device is mounted to a main assembly casing of the image forming apparatus so that the image bearing member and the developer carrying member are opposed to each other with a predetermined gap (up to about 300 μm). Further, in order to compensate for the developer consumed by image formation, a developer supplying device for supplying a developer to the developing device through a developer supply port is connected to the developing device.

Japanese Laid-Open Patent Application (JP-A) Hei 11-174843 discloses an image forming apparatus capable of supplying the developer in a uniform supply amount over a longitudinal direction of a developer carrying member by providing a magnet roller inside a developer supply port which is opened and elongated in the longitudinal direction of the developer carrying member and then by rotating the developer carrying member. However, in the image forming apparatus of JP-A Hei 11-174843, the developing device and the developer supplying device are integrally connected and therefore only the developing device cannot be pulled out.

JP-A Hei 4-333077 discloses an image forming apparatus in which the developer supplying device is configured to be separable from a relatively large-sized developing device fixed in the main assembly casing by being mounted and demounted. In this image forming apparatus, a shutter member is provided to the developer supplying device slides and moves on a bottom surface of the developer supplying device by mounting and demounting from the developing device to cover the developer supply port. As a result, dropping of the developer into peripheral portions through the developer supply port of the developer supplying device is prevented.

In this case, the shutter member is urged by a spring in a direction in which the developer supply port is to be covered. For this reason, when the developer supplying device is demounted from the developing device, by movement of the developer supplying device, the developer supply port is quickly covered with the shutter member which has been urged by the spring, so that leaking of the developer is prevented.

In recent years, the image forming apparatus has been required to mount therein a large-capacity developer supplying device while realizing downsizing. For this reason, in contract to the constitution of JP-A Hei 4-333077, a constitution in which a small-sized developing device can be pulled out while leaving a large-sized developer supplying device in the main assembly casing has been needed.

Therefore, in such a constitution, a mounting and demounting structure for the developing device and the developer supplying device as described in JP-A Hei 4-333077 has been employed. This structure has a constitution in which the shutter member which can slide and move while being urged by the spring toward the developer supply port which is opened at the bottom surface of the developer supplying device is provided.

However, in the case of the elongated developer supply port as described in JP-A Fei 11-174843, compared with the short developer supply port as described in JP-A Hei 4-333077, a peripheral length of a lip portion to be sealed is long and therefore a frictional load of the shutter member when the shutter member is closed becomes large remarkably large. In order to cover the developer supply port by overcoming the large frictional load, a large spring-urging force is required.

The large spring-urging force moves and deforms the developing device, so that there is a possibility that a relative positional relationship between a photosensitive drum and the developer carrying member, i.e., a development gap is unstable and thus an image quality is lowered.

Particularly, in the case where the developer supplying device is left on the main assembly casing side and the developing device is configured so that the developing device can be pulled out in a direction in which the developing device is moved away from the image bearing member, the spring urging for closing the shutter member presses back the developing device in the pulling-out direction. As a result, when the developing device is obliquely tilted in a flat plane to cause a difference in gap between the developer carrying member and the image bearing member with respect to the longitudinal direction, a difference in development density with respect to the longitudinal direction has becomes conspicuous.

SUMMARY OF THE INVENTION

A principal object of the present invention is to provide an image forming apparatus capable of moving a shutter member in interrelation with a mounting and demounting operation of a developing device without employing a constitution in which the shutter member is urged by a spring in an opening and closing direction.

According to an aspect of the present invention, there is provided an image forming apparatus comprising:

an image bearing member;

a developing device provided movably in a direction in which the developing device is to be moved away from the image bearing member;

a supplying device, provided with a supply port through which a developer is to be supplied, for supplying the developer;

a shutter member provided so that the supply port can be covered and uncovered;

a first interrelating mechanism for moving the shutter member from an opposing position in which the shutter member opposes the supply port to a retracted position in interrelation with a mounting operation of the developing device; and a second interrelating mechanism for moving the shutter member from the retracted position to the opposing position in interrelation with a demounting operation of the developing device, wherein the second interrelating mechanism includes an engaging portion for engaging the shutter member with the developing device by moving the shutter member to the retracted position and includes a releasing portion for releasing engagement between the shutter member and the developing device by moving the shutter member to the opposing position.

These and other objects, features and advantages of the present invention will become more apparent upon a consideration of the following description of the preferred embodiments of the present invention taken in conjunction with the accompanying drawings.

Figure 3:
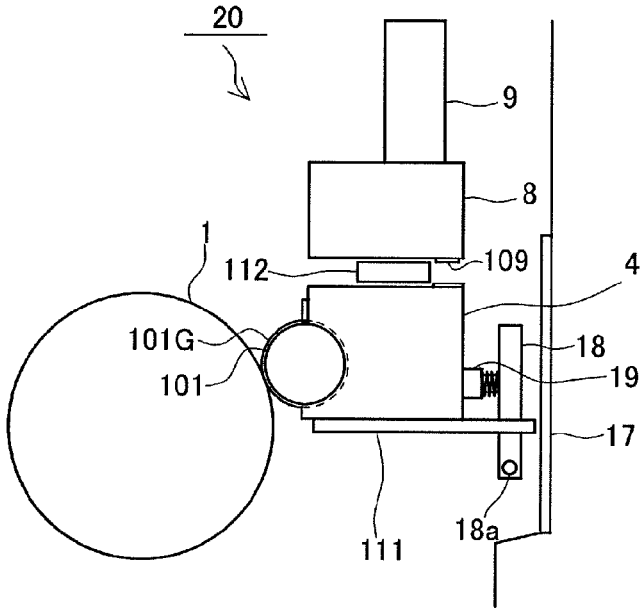
Figure 3:
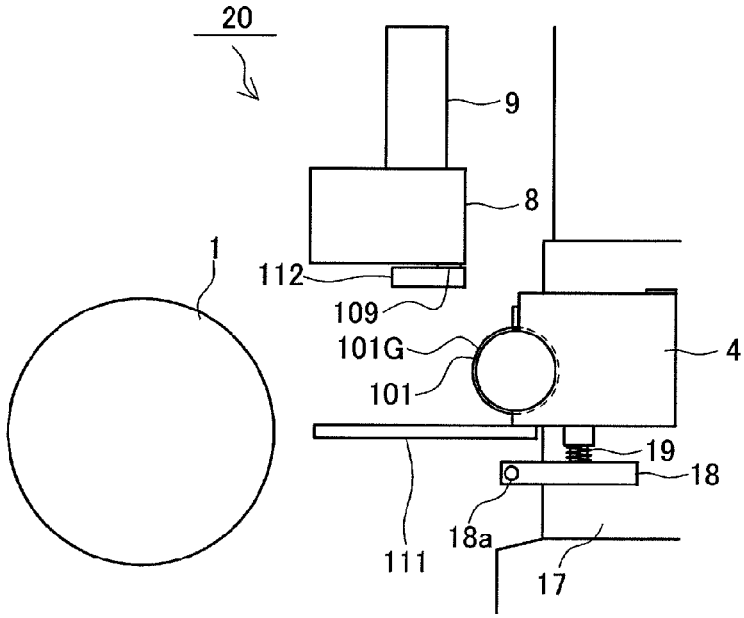

Parts (a) and (b) of FIG. 3 are illustrations of a mounting and demounting (pulling out) operation of the developing device, respectively.

Figure 4:
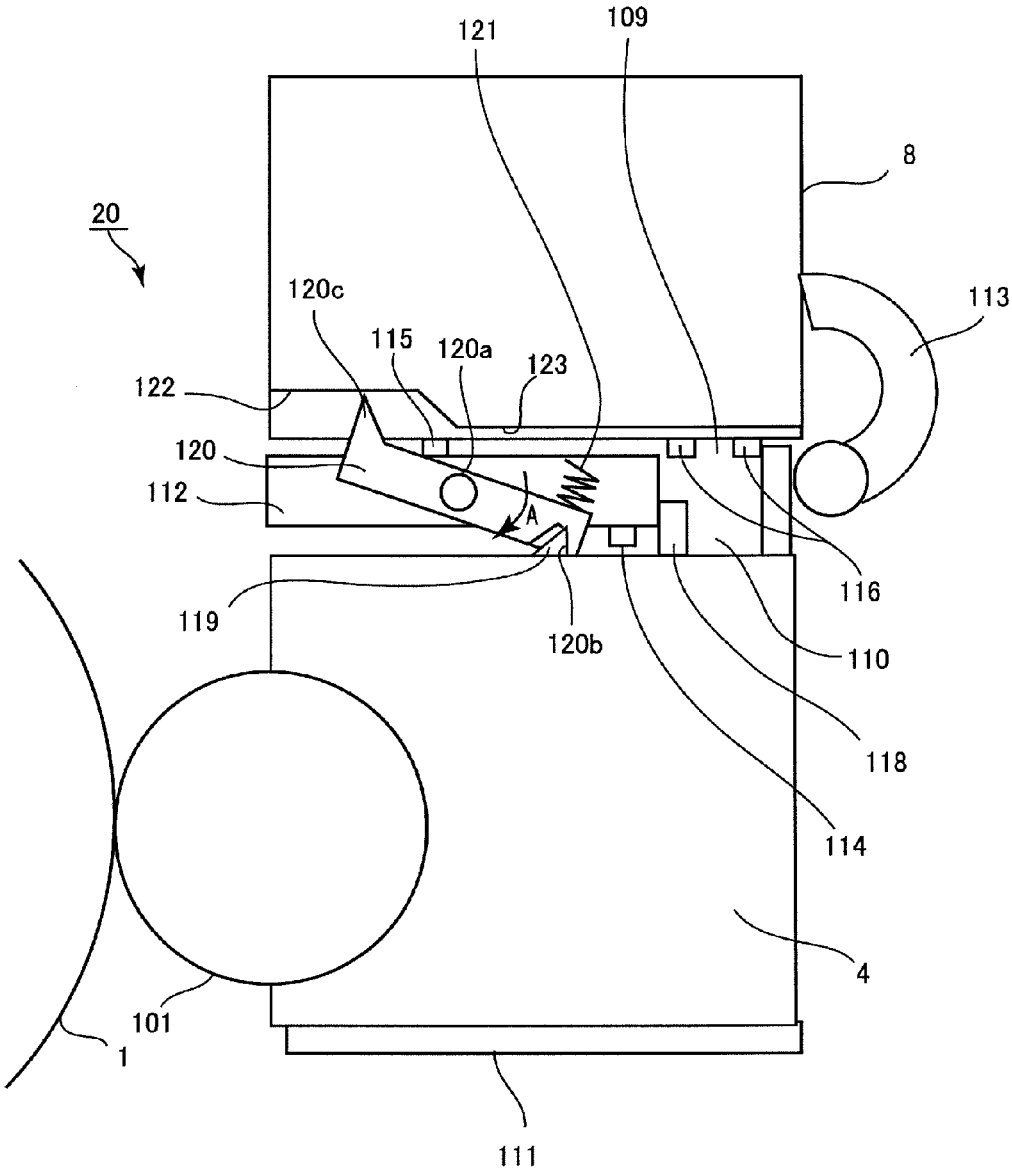

FIG. 4 is an illustration of a structure of a shutter driving mechanism.

Figure 5:
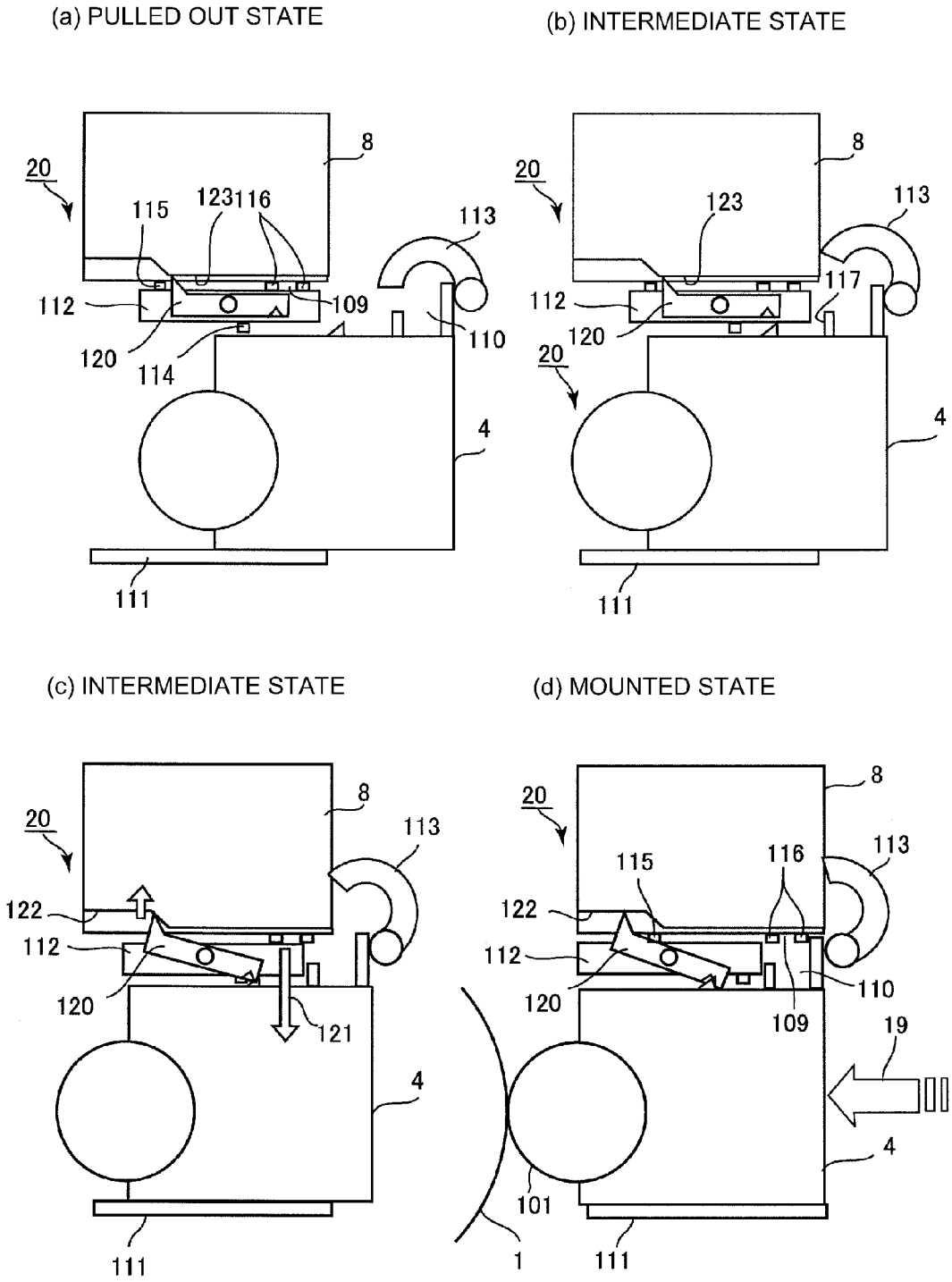

Parts (a) to (d) of FIG. 5 are illustrations of a shutter operation.

DESCRIPTION OF THE PREFERRED EMBODIMENTS

Embodiments of the present invention will be described in detail with reference to the drawings. The present invention can also be carried out in other embodiments in which a part or all of constitutions in the following embodiments are replaced with their alternative constitutions so long as a developing device is demountable in a direction in which a developer carrying member is moved apart from an image bearing member.

Therefore, the present invention can be carried out by the image forming apparatus including the developing device irrespective of the types of charging and electrostatic image formation and irrespective of the types of intermediary transfer, recording material conveyance, transfer belt and sheet-feed printing.

In the following embodiments, only principal portions relating to formation of a toner image will be described but the present invention can be carried out in various uses such as a printer, various printing machines, a copying machine, a facsimile machine and a multi-function machine by adding necessary devices, equipment and casing structures.

Incidentally, general matters of the image forming apparatuses described in JP-A Hei 11-174843 and JP-A Hei 4-333077 will be omitted from illustration and redundant description.

<Image Forming Apparatus>

Figure 1:
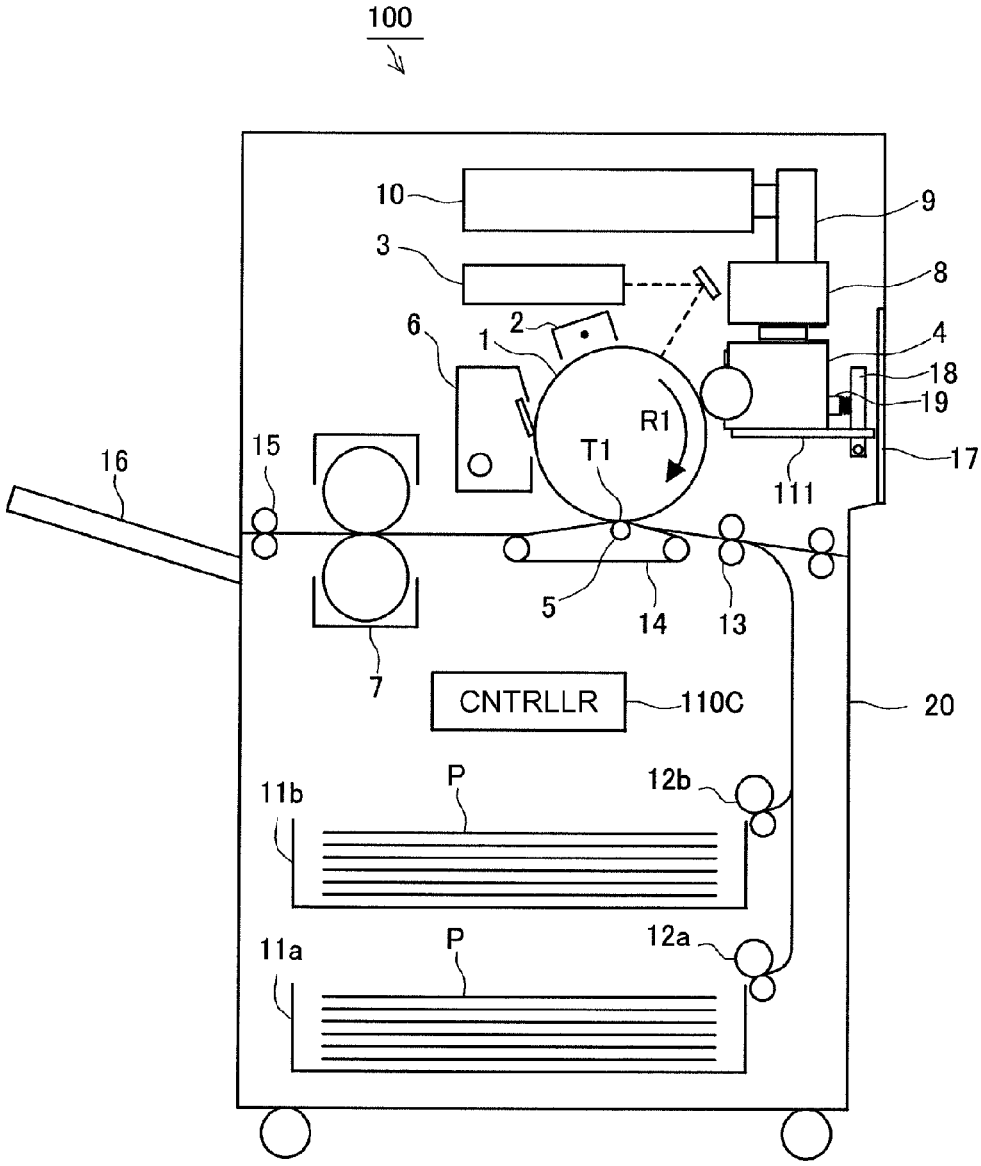
FIG. 1 is an illustration of a structure of an image forming apparatus.

FIG. 1 is an illustration of a structure of the image forming apparatus. As shown in FIG. 1, an image forming apparatus 100 is a high-speed monochromatic printer in which the toner image formed on a photosensitive drum 1 is transferred onto a recording material P carried on a transfer belt 14.

A corona charger 2, an exposure device 3, a developing device 4, a transfer belt 14 and a drum cleaning device 6 are disposed around the photosensitive drum 1 which is an example of the image bearing member. The photosensitive drum 1 is prepared by forming a photosensitive layer on an outer peripheral surface of an aluminum cylinder and is rotated in a direction indicated by an arrow R1 at a process speed of 700 mm/sec.

The corona discharger 2 uniformly charges the surface of the photosensitive drum 1 to a negative potential by irradiating the surface of the photosensitive drum 1 with charged particles by corona discharge. The exposure device 3 writes (forms) an electrostatic image for an image on the charged surface of the photosensitive drum 1 by scanning the photosensitive drum 1 surface with a laser beam, through a rotating mirror, which has been subjected to ON-OFF modulation of scanning line image data developed from an input image. The developing device 4 develops the electrostatic image formed on the photosensitive drum 1 into the toner image.

A transfer roller 5 presses an inner surface of the transfer belt 14 to form a transfer portion T1 between the photosensitive drum 1 and the transfer belt 14. The recording material P accommodated in a recording material cassette 11*a* is separated one-by-one by a separation roller 12*a* and is fed to registration rollers 13. The registration rollers 13 receive the recording material P in a rest state to place the recording material P in a stand-by state and then send the recording material P by being timed to the toner image on the photosensitive drum 1.

By applying a positive DC voltage to the transfer roller 5, the toner image carried on the photosensitive drum 1 is transferred onto the recording material P which is carried on the transfer belt 14 and passes through the transfer portion T1. The recording material P on which the toner image is transferred is separated by curvature from the transfer belt 14 and is sent into a fixing device 7. The recording material P is subjected to heat and pressure by the fixing device 7 to heat-fix the toner image on its surface and thereafter is discharged on a discharge tray 16 through discharging rollers 15.

The drum cleaning device 6 rubs the photosensitive drum 1 with a cleaning blade to collect transfer residual toner remaining on the photosensitive drum 1 without being transferred onto the recording material P.

<Developing Device>

Figure 2:
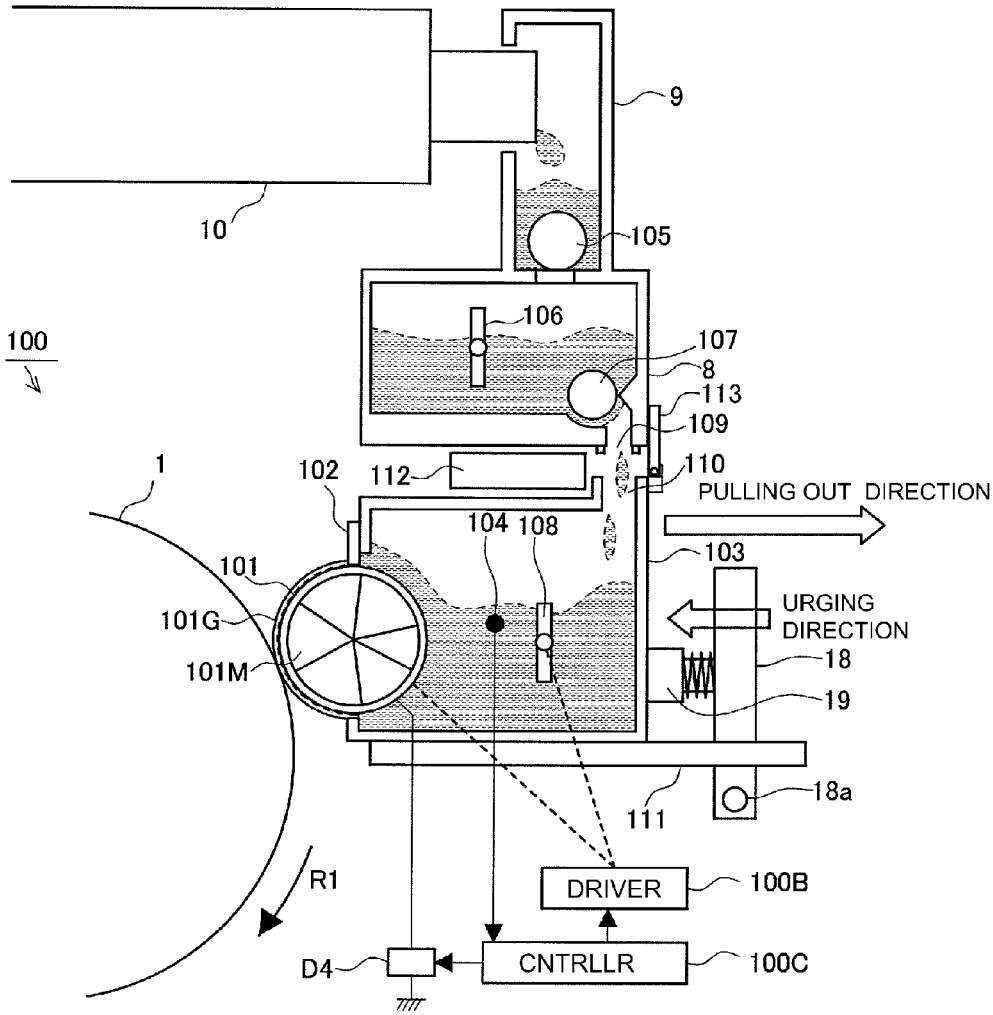
FIG. 2 is an illustration of a structure of a developing device.

FIG. 2 is an illustration of a structure of the developing device. Parts (a) and (b) of FIG. 3 are illustrations of mounting and demounting of the developing device, respectively.

As shown in FIG. 2, the developing device 4 carries a developer (magnetic toner; a one-component developer) on a developing sleeve 101 which is an example of a developer carrying member and develops the electrostatic image into the toner image on the photosensitive drum 1. A stationary magnet 101M is disposed inside the developing sleeve 101. The stationary magnet 101M attracts the developer by magnetic flux and coats the surface of the developing sleeve 101 with the developer.

A developing blade 102 regulates a layer thickness of the developer carried on the developing sleeve 101 and electrically charges the developer to a negative polarity by rubbing against the developer. A power source D4 applies an oscillating voltage, in the form of a DC voltage biased with an AC voltage, to the developing sleeve 101. The charged developer carried on the developing sleeve 101 is strongly reciprocated at an opposing portion between the developing sleeve 101 and the photosensitive drum 1 in response to the AC voltage and then is transferred onto the photosensitive drum 1. Thus, the electrostatic image on the photosensitive drum 1 is reversely developed.

A developer supplying system is constituted in the order of a toner container 10, a hopper device 9, a buffer device 8 and the developing device 1.

The toner is consumed by the image formation and therefore toner in an amount corresponding to a toner consumption amount is supplied from the toner container 10 to the hopper device 9 and then is supplied from the hopper device 9 to the developing device 4 via the buffer device 8.

The hopper device 9 and the buffer device 8 are mounted to a main assembly casing 20 (FIG. 1), and the toner container 10 is a consumable part to be replaced with a fresh ene container by being demounted and mounted. The developing device 4 is detachably mountable to the main assembly casing 20 for maintenance, exchange and the like by being pulled out in a right-hand direction in FIG. 2.

The hopper device 9 is provided with an unshown rotating mechanism for rotating the toner container 10 to take the toner into the hopper device 9. The hopper device 9 supplies the developer to the buffer device 8 by rotating a feeding screw 105 by an angle corresponding to a supply amount.

The buffer device 8 is provided right above the developing device 4, and stores the developer and supplies the developer to a receiving port 110 of the developing device 4. The buffer device 8 includes a stirring device 106, a magnet roller 107 and an unshown toner sensor.

A controller 100C supplies the toner from the hopper device 9 to the buffer device 8 by actuating the feeding screw 105 of the hopper device so that a toner level in the buffer device 8 can be kept in a predetermined range.

A developer supply port 109 provided at the bottom surface of the buffer device 8 is formed in an elongated shape in a full length with respect to the longitudinal direction of the developing device 4. The magnet roller 107 is provided in a full length with respect to the longitudinal direction of the buffer device 8 and is rotated inside the developer supply port 109, so that the magnet roller 107 feeds the developer to the receiving port of the developing device 4 with a uniform amount distribution with respect to the longitudinal direction of the developing device 4. By rotating the magnetic roller 107, the developer in an amount corresponding to the amount of the developer consumed by the image formation is supplied to the receiving port 110 of the developing device 4.

The buffer device 8 supplies the toner (developer) to the developing device 4 evenly with respect to the longitudinal direction of the developing device 4 and thus a slope of the toner surface with respect to the longitudinal direction of the developing device 4 is less liable to be formed, so that the buffer device 8 is effective in uniformly keeping an image density with respect to the longitudinal direction of the developing sleeve 101. The developing device 4 includes a stirring device 108 and a toner sensor 104.

The stirring device 108 stirs the developer, in a developing container 103, supplied from the receiving port 110 and feeds the developer to the developing sleeve 101 while keeping flowability of the developer. The toner sensor 104 detects an amount of AC current flowing between itself and the ground potential and outputs a signal corresponding to the amount of the developer in the developing container 103.

The controller 100C effects the toner supply from the buffer device 8 to the developing container 103 by actuating the magnetic roller 107 so that a toner level in the developing container 103 detected by the toner sensor 104 can be kept in a predetermined range.

The controller 100C controls the feeding screw 105 and the magnet roller 107 depending on an output of the toner sensor 104. A driving portion 100B rotationally drives the stirring member 108 and the developing sleeve 101.

As shown in (a) of FIG. 3, a developing rail 111 supports the developing device 4 movably from the photosensitive drum 1 in a direction in which the developing device 4 is to be moved away from the photosensitive drum 1. The developing device 4 is urged toward the photosensitive drum 1 by an urging spring 19 provided on an inner door 18, so that spacer rollers 101G are contacted to the photosensitive drum 1. A both end portions of the developing sleeve 101, the spacer rollers 101G of an insulating material are contacted to the photosensitive drum 1, so that an opposing distance between the developing sleeve 101 and the photosensitive drum 1 (SD gap) is set at 200 μm.

As shown in (b) of FIG. 3, the urging of the developing device 4 toward the photosensitive drum 1 can be released by opening an outer cover 17 and then by laying the inner door 18 rightward on its side with a supporting shaft 18*a* as the center. The developing device 4 is guided by the developing rail 111 to be pulled out in a right-hand direction, so that the developing device 4 is demountable from the main assembly casing 20. When the developing device 4 is pulled out, a shutter 112 is configured to cover the developer supply port 109 of the buffer device 8.

Incidentally, JP-A Hei 4-333077 discloses an image forming apparatus in which die shutter is always urged by the spring in the closing direction in order to cover the developer supply port of the toner cartridge. In the image forming apparatus, in which the operation for mounting the toner cartridge to the developing device, the shutter is moved against the spring urging to uncover the developer supply port. Then, when the toner cartridge is separated from the developing device, the spring urging pulls back the shutter, so that the developer supply port is covered.

However, in the type in which sealing (covering) is effected by urging the shutter with the spring in the closing direction, in a state in which the shutter is opened, i.e., in a normal operation state, a spring urging force for causing the shutter to be closed is exerted on the developing device.

For this reason, in the case of the constitution in which the shutter 112 is directly urged by the spring, a force for pressing back the developing device 4 from the photosensitive drum 1 is generated, so that the urging force toward the photosensitive drum 1 at both end portions of the developing sleeve 101 with respect to the longitudinal direction is liable to be out of balance. The urging force for urging the developing device 4 toward the photosensitive drum 1 becomes unstable, so that a contact state between the photosensitive drum 1 and the spacer rollers 101G is changed during the image formation, thus causing rotation non-uniformity of the photosensitive drum 1. As a result, a reproducibility of the opposing distance (SD gap) between the developing sleeve 101 and the photosensitive drum 1 was lowered to have the influence on the image formation in some cases.

This tendency is, in the case where a shutter area is large, noticeable since a sealing force for the shutter is increased to increase reaction force exerting on the developing device and thus the reproducibility becomes further unstable.

Therefore, in the following embodiment, when the shutter 112 is opened and closed, the spring for urging the developing device 4 so as to generate a pressing-back force for pressing back the developing device 4 from the photosensitive drum 1 is not used. That is, a mechanism by which the reaction force is not exerted on the developing device 4 in the state in which the shutter 112 is opened is employed. As a result, the force is not applied to the developing device 4 and therefore the urging force of the developing device 4 against the photosensitive drum 1 is stabilized to maintain an image formation quality.

Embodiment 1

FIG. 4 is an illustration of a structure of the shutter driving mechanism. Parts (a) to (d) of FIG. 5 are schematic views for illustrating an operation of the shutter.

As shown in FIG. 4, the buffer device 8 which is an example of the developer supplying device supplies the developer to the developing device 4 through the developer supply port 109 opened and elongated in the longitudinal direction of the developing sleeve 101 which is an example of the developer carrying member. The shutter 112 which is an example of the shutter member is movable in the movement direction of the developing device 4 in order to cover the developer supply port 109. A pushing-in portion 118 which is an example of a first interrelating mechanism retracts the shutter 112 from the developer supply port 109 (uncovers (opens) the developer supply port 109) in interrelation with the movement of the developing device 4 in a main assembly-side mounting direction (opposite to a direction in which the developing device 4 is moved away from the photosensitive drum 1). The pressing-in portion 118 is a contact portion to be contacted to the shutter 112.

A shutter arm which is an example of a second interrelating mechanism moves the shutter 112 to an opposing position when the shutter 112 opposes the developer supply port 109 (covers (closes) the developer supply port 109) in which the movement of the developing device 4 in the direction in which the developing device 4 is moved away from the photosensitive drum 1. The shutter arm 120 is, when the shutter 112 is retracted from the developer supply port 109 (when the developer supply port 109 is opened), rotated by a guide surface 122 and a spring 121. Then, an end hood portion 120*b* of the shutter arm 120 is engaged with a locking portion 119 of the developing device 4, so that the shutter 112 is engaged with the developing device 4. On the other hand, the shutter arm 120 is a mechanism for releasing the engagement of the shutter 112 with the developing device 4 after the shutter 112 is closed to cover the developer supply port 109. The shutter arm 120 is an engaging member for engaging the shutter 112 with the developing device 4 by relative movement between the shutter 112 and the buffer device 8. The buffer device 8 has guide surfaces 122 and 123 on which the shutter arm 120 is to be rotated in an engaging direction and a releasing direction by relative movement between the buffer device 8 and the shutter 112.

At the bottom surface of the buffer device 8, the developer supply port 109 formed and elongated in the longitudinal direction of the developing sleeve 101 is opened, so that the toner in the buffer device 8 is supplied from the developer supply port 109 into the developing device 4.

On the other hand, the developing device 4 is provided with the receiving port 110 for receiving the toner discharged from the developer supply port 109, and the receiving port is formed in larger in width and length than the developer supply port 109. When the developing device 4 is mounted in the main assembly casing 20 along the developing device rail 111, the developer supply port 109 of the buffer device 8 and the receiving port 110 of the developing device 4 overlap with each other, so that the toner can be supplied.

Further, when the developing device 4 is demounted from the main assembly casing 20, in order to prevent scattering of the toner dropped from the developer supply port 109 into the main assembly casing 20, the shutter 112 is provided at the receiving port 109 of the buffer device 8. Further, in order that a foreign matter does not enter the receiving port 110 of the demounted developing device 4, the receiving port 110 is provided with a developer entrance cover 113. Incidentally, the developer entrance cover is urged by an unshown torsion coil spring in a direction in which the receiving port 110 is to be covered. Further, the developer entrance cover 113 is configured to be opened against the spring urging by being contacted to the buffer device 8 by the mounting of the developing device 4 to be raised at its rotation end.

The shutter 112 of the buffer device 8 is held slidably on a lower surface of the buffer device 8. By the movement of the developing device 4, the shutter slides in both directions, so that the developer supply port 109 of the buffer device 8 is uncovered or covered. Specifically, first T-shaped rails are attached to the lower surface of the buffer device 8 with an interval of 100 mm in the mounting and demounting direction, and the shutter 112 is provided with T-shaped grooves which hold the cross section of the T-shaped rails with play. The T-shaped grooves are formed so as avoid a seal (covering) surface of the shutter 112 and therefore the toner is not leaked out.

In order to absorb the play of the shutter 112, at the lower surface of the buffer device 8, slide guides 114 and 115 for supporting the shutter 112 are provided separately from each other with respect to the sliding direction. The slide guide 114 guides the lower surface of the shutter 112, and the slide guide 115 guides the upper surface of the shutter 112.

Further, a seal (for sealing) 116 having the substantially same height as that of the slide guide 115 is provided so as to surround the developer supply port 109. The seal 116 is provided to surround the developer supply port 109 and is elastically deformable in a compression direction. The seal 116 is formed of a rubber material having sponge a sponge-like texture.

The slide guide 115 which is an example of a first slide guide supports the shutter 112 in a thickness direction on the same side as that of the seal 116. The slide guide 114 which is an example of a second slide guide supports the shutter 112 in the thickness direction from the side opposite from the slide guide 115 side at an intermediate position the seal 116 and the slide guide 115 with respect to the movement direction of the shutter 112.

In a state in which the shutter 112 is closed to cover the developer supply port 109, the shutter 112 supported by the slide guides 114 and 115 compresses and deforms the seal 116 in the thickness direction.

By disposing the slide guides 114 and 115 as described above, in the state in which the shutter 112 is closed to cover the developer supply port 109, the slide guides 114 and 115 urge the shutter 112 toward the shutter 116 to enhance a sealing performance.

Further, by disposing the slide guides 114 and 115 as described above, in a state in which the shutter is slid and is completely opened to uncover the developer supply port 109, the shutter 112 is held at upper and lower (two) slide surfaces provided at different positions with respect to the sliding direction. For this reason, the urging force of the slide guides 114 and 115 is little exerted, so that the frictional force between the shutter 112 and the slide guides 114 and 115 is considerably alleviated.

On the other hand, in the state in which the shutter 112 is slid and closed to cover the developer supply port 109, the shutter 112 is non-rotatably sandwiched by the seal 116 and the slide guides 114 and 115. For this reason, the shutter 112 generates the urging force toward the seal 116, thus sealing the developer supply port 109 with reliability.

The shutter 112 is, when the developing device 4 is mounted, contacted to an abutment surface 117 of the pushing-in portion 118 on the developing device 4 side and then is slid together with the developing device 4 toward the photosensitive drum 1. As a result, the shutter 112 is opened to uncover the developer supply port 109.

When the developing device 4 is pulled out, the end hood portion 120*b* of the shutter arm 120 is engaged with the locking portion 119 of the developing device 4 and then the shutter 112 is slid together with the developing device 4 in the direction in which the shutter 112 is moved away from the photosensitive drum 1. As a result, the shutter 112 is closed to cover the developer supply port 109.

At the longitudinal end portions of the shutter 112, a pair of shutter arms 120 is mounted rotatably about the rotation shafts 120*a*. A shutter arm spring 121 urges the hook portion 120*b* of the associated shutter arm 120 so as to be rotated toward the developing device 4. The shutter arm 120 is prevented from being rotated by the urging of the shutter arm spring 121, by the contact of an end portion 120*c* thereof, opposite from the hook portion 120*b*, with the guide surface 122.

At the lower surface of the buffer device 8, the guide surfaces 122 and 123 for permitting rotation of the shutter arm 120 against the urging of the shutter arm spring 121 are provided. The shutter arm 120 is urged so that the end portion 120*c* is contacted to the guide surface 122 by the shutter arm spring 121.

In a process in which the developing device 4 is pulled out from the main assembly casing 20, during the contact of the end portion 120*c* with the guide surface 122, the shutter arm 120 is rotated to a position in which the hook portion 120*b* is engageable with the position 119 of the developing device 4. However, when the shutter 112 is moved on the bottom surface of the buffer device 8 and is then contacted to the guide surface 123 at the end portion 123*c*, the shutter arm 120 is rotated to a position in which the engagement of the hook portion 120*b* with the position 119 is released.

That is, the guide surfaces 122 and 123 engage, when the developing device 4 is mounted in the main assembly casing 20 to open the shutter 112, the hook portion 120*b* of the shutter member 120 with the locking portion 119 of the developing device 4. Further, when the developing device 4 is demounted from the main assembly casing 20, the engagement between the hook portion 120*b* of the shutter arm 120 and the locking portion 119 of the developing device 4 is released.

As shown in (a) of FIG. 5, when the developing device 4 is mounted in the main assembly casing 20 along the developing device rail 111, the developer entrance cover 113 is to be contacted to the buffer device 8 and then upwardly rotated, so that the receiving port of the developing device 4 is uncovered.

As shown in (b) of FIG. 5, when the developing device 4 is moved and then the pushing-in portion 118 (abutment surface 117) and the shutter 112 are to be contacted to each other, the shutter 112 is pushed by the developing device 4 to be slid, so that the shutter 112 starts to open.

As shown in (c) of FIG. 5, when the shutter 112 starts to open, the shutter arm 120 is rotated along the guide surface 122, so that the shutter arm 120 is to be engaged with the longitudinal direction 119 of the developing device 4.

As shown in (d) of FIG. 5, when the shutter 112 is completely opened to uncover the developer supply port 109 of the buffer device 8 and the developing device 4 is further moved, the developing device 4 is located at a predetermined position where the developing device 4 opposes the photosensitive drum 1.

At this time, by the constitution of disposition of the slide guides 114 and 115 and the seal 116, as described above, the frictional force of the shutter 112 by its movement is considerably alleviated. As a result, the force applied from the shutter 112 to the developing device 4 in the sliding direction is considerably relaxed. For this reason, even in the case where the peripheral length of the seal 116 of the developer supply port 109 is long and thus a sliding resistance of the shutter 112 is large, after the shutter 112 is opened, the force is not substantially exerted on the developing device 4. The urging force of the developing device 4 toward the photosensitive drum 1 is less influenced by the shutter 112.

As shown in (d) of FIG. 5, when the pulling-out of the developing device 4 from the main assembly casing 20 is started, the shutter arm 120 and the locking portion 119 of the developing device 4 are engaged and therefore the shutter 112 starts to slide in interrelation with the developing device 4.

As shown in (c) of FIG. 5, in the neighborhood of the position in which the shutter 112 covers the developer supply port 109 of the buffer device 8, the guide surfaces 122 and 123 to which the shutter arm 120 is contacted form an inclined surface, at which the shutter arm 120 starts its rotation.

As shown in (b) of FIG. 5, when the shutter 112 completely covers the developer supply port 109 of the buffer device 8, the shutter arm 120 reaches the guide surface 123, so that the engagement between the shutter arm 120 and the position 119 of the developing device 4 is released. As a result, the closing operation of the shutter 112 is completed.

At this time, the engagement between the shutter arm 120 and the locking portion 119 of the developing device 4 is released after the developer supply port 109 is completely covered with the shutter 112, so that it is possible to reduce the amount of the toner leaked from the developer supply port 109. Further, the shutter 112 can be sufficiently slid after covering the developer supply port 109 and therefore the engagement between the shutter arm 120 and the locking portion 109 of the developing device 4 can be released with reliability. For this reason, it becomes possible to smoothly demount the developing device 4.

In the state in which the shutter 112 covers the developer supply port 109, by the constitution of disposition of the slide guides 114 and 115 are the seal 116, as described above, the shutter 112 generates the sealing force for sealing the developer supply port 109. For this reason, a degree of the toner leakage from the developer supply port 109 is considerably reduced.

As shown in (c) and (b) of FIG. 5, when the developing device 4 is pulled out, the developer entrance cover 113 is separated from the buffer device 8, so that the developer entrance cover 113 is closed by its own weight or by an unshown torsion spring or the like. For this reason, the receiving port 110 of the developing device 4 is sealed, so that the inclusion of the foreign matter into the developing device 4 can be prevented.

According to the shutter mechanism in this embodiment, when the developing device 4 is mounted, the urging force of the developing device 4 toward the photosensitive drum 1 is reproduced as in an original manner. When the developing device 4 is pulled out, the developer supply port 109 is sealed with a high performance, so that the amount of leakage of the toner can be remarkably reduced.

Further, during the mounting and demounting of the developing device 4, the shutter 112 for covering the developer supply port 109 is automatically opened and closed by the mounting and demounting of the developing device 4. For this reason, not only a service person having expertise in a copying machine but also a user having no expertise can automatically operate the shutter 112 together with the developing device 4 when the mounting and demounting of the developing device 4 can be performed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 044328/2010 filed Mar. 1, 2010, which is hereby incorporated by reference.

What is claimed is:

1. A supplying apparatus provided with a supply port through which developer is to be supplied to a developing device, comprising:

a shutter member, provided so as to be slidable in a mounting and demounting direction of the developing device, for covering and uncovering the supply port;

an opening and closing mechanism for moving said shutter member from an opposing position, where said shutter member opposes the supply port port, to a retracted position in interrelation with a mounting operation of the developing device;

an engaging member provided to said shutter member so as to be rotatable relative to said shutter member and being engageable with the developing device;

an urging member for urging said engaging member in a rotational direction of said engaging member; and a guiding portion for guiding said engaging member so that said engaging member is rotated, when said shutter member is slid in interrelation with the mounting operation of the developing device from a releasing position where said engaging member does not engage with the developing device to an engaging position where said engaging member engages with the developing device.

2. An apparatus according to claim 1, further comprising:

a seal, provided so as to surround the supply port, capable of being deformed in a compression direction;

a first slide guide for supporting said shutter member with respect to a thickness direction on the same side as said seal; and a second slide guide for supporting said shutter member with respect to the thickness direction from an opposite side to said first slide guide at an intermediate position between said seal and said first slide guide with respect to a movement direction of said shutter member, wherein in a state in which said shutter member is closed to cover said supply port, said shutter member supported by said first and second slide guides compressively deforms said seal in the thickness direction.

* * * * *